United States Patent [19]

Schiel

[11] 4,282,656

[45] Aug. 11, 1981

[54] CYLINDER FOR A PAPER MACHINE, OR THE LIKE

[75] Inventor: Christian Schiel, Heidenheim, Fed. Rep. of Germany

[73] Assignee: J. M. Voith GmbH, Fed. Rep. of Germany

[21] Appl. No.: 91,397

[22] Filed: Nov. 6, 1979

[30] Foreign Application Priority Data

Nov. 15, 1978 [DE] Fed. Rep. of Germany ..... 2849454

[51] Int. Cl.[3] ..... F26B 25/20

[52] U.S. Cl. ..... 34/110; 34/119; 34/124; 34/231; 165/89; 165/109 R

[58] Field of Search ..... 34/110, 119, 124, 125, 34/108, 231; 432/118; 366/228; 165/76, 89, 109

[56] References Cited

U.S. PATENT DOCUMENTS

| | | | |
|---|---|---|---|
| 1,860,738 | 5/1932 | Harty et al. | 34/134 |
| 3,217,426 | 11/1965 | Barnscheidt et al. | 34/110 |
| 4,195,417 | 4/1980 | Mathews | 34/124 |

FOREIGN PATENT DOCUMENTS

2330199 Fed. Rep. of Germany .

*Primary Examiner*—Larry I. Schwartz
*Attorney, Agent, or Firm*—Ostrolenk, Faber, Gerb & Soffen

[57] ABSTRACT

A hollow cylinder is provided on its interior surface with an annular array of a plurality of annularly spaced, longitudinal ridges. The ridges are held in place by at least one inner support disposed inside the cylinder. A respective longitudinally extending bar is disposed radially inwardly of each ridge and springs bias the bar radially inwardly. The bars engage the support ring. The resultant resilient connection between the support ring and the ridges urges the ridges against the interior surface of the shell. The inner support ring may be constructed of several joined arcuate segments.

20 Claims, 5 Drawing Figures

CYLINDER FOR A PAPER MACHINE, OR THE LIKE

BACKGROUND OF THE INVENTION

The present invention relates to a cylinder, particularly drying cylinder for a paper machine and more particularly to a drying cylinder of the type having longitudinal ridges spaced apart from each other around the inner surface of the cylinder. It is known to employ such ridges to break up any layer of liquid which forms on the inner surface of the cylinder during operation.

As shown in U.S. Pat. No. 3,217,426, it is known to fasten such ridges by means of clamping rings located radially inward from the ridges and pressing directly radially outward against the ridges. This arrangement, however, has not been successful in practice because, with the passage of time, the clamp connection loosens as a result of differential thermal expansion of the various parts. Federal Republic of Germany Unexamined Patent Application (Offenlegungsschrift) No. 23 03 334, discloses subdividing each ridge into segments and attaching each segment to the cylinder wall by means of screws. This method, however, not only requires extensive drilling work but also weakens the wall of the cylinder. Finally, Federal Republic of Germany Provisional Patent (Auslegeschrift) 23 30 199 discloses holding the ridges in place by means of spring bars. This arrangement is, however, cumbersome to assemble and does not assure uniform spacing of the ridges, which can lead to imbalances and other disadvantages in operation.

SUMMARY OF THE INVENTION

The present invention has the object of holding a plurality of longitudinally extending ridges in place in primarily a force-locked manner on the inner surface of a hollow cylinder, such as a rotating cooling cylinder or a drying cylinder for a paper machine.

It is another object to hold the ridges without substantially damaging or weakening the wall of the cylinder by implantation therein of fastening means.

It is a further object to hold the ridges in such a manner that the ridges are free to expand independently of the cylinder wall with temperature variations so that even if the ridges and the wall have different coefficients of thermal expansion, temperature changes will not cause the ridges to pull away from the wall in such a way as to damage the wall.

It is yet another object to provide a method of attaching the ridges such that they can easily be installed in a cylinder where access is restricted.

These objects are achieved in accordance with one preferred embodiment of the present invention by providing a hollow cylinder, that is useful in paper machine machines, or the like, for serving as the drying cylinder, or the like, and providing an annular array inside the cylinder of generally longitudinally extending, annularly spaced apart ridges for breaking up liquid flow, or the like purposes. A common support means resiliently urges all of the ridges against the interior surface of the cylinder. The common support means comprises a common support in the cylinder and a series of bars interposed between the common support and the ridges for resiliently engaging the ridges. Preferably, a respective bar is provided for each ridge. Biasing means interposed between each ridge and its bar coact with the common support in engagement with the bar to resiliently bias the ridges against the cylinder interior. The common support may be a ring and the ring may itself be resiliently radially deflectable. The ring may be comprised of a series of attached together arcuate segments. Several longitudinally spaced apart, annular arrays of ridges may be provided in the cylinder.

Other objects and features of the invention will be explained below in further detail with reference to accompanying drawings.

DESCRIPTION OF THE PREFERRED EMBODIMENTS

Figure 1:
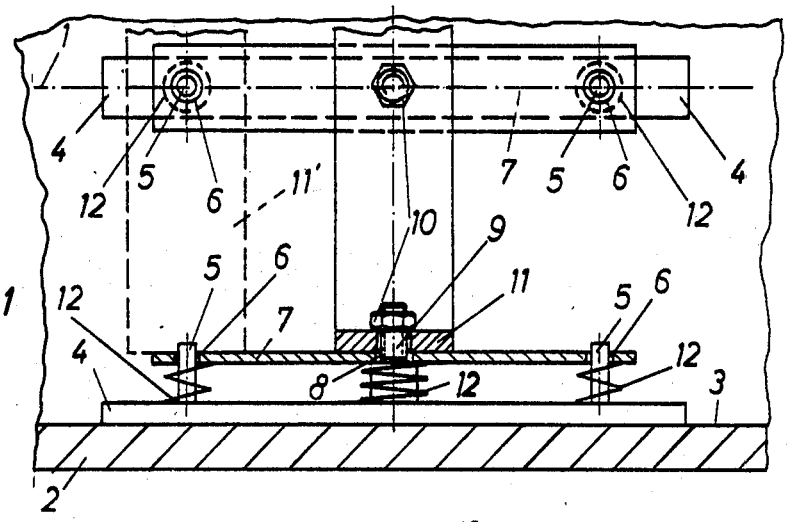
FIG. 1 is a partial longitudinal view in section of a cylinder having built-in ridges in accordance with the present invention.
Figure 2:
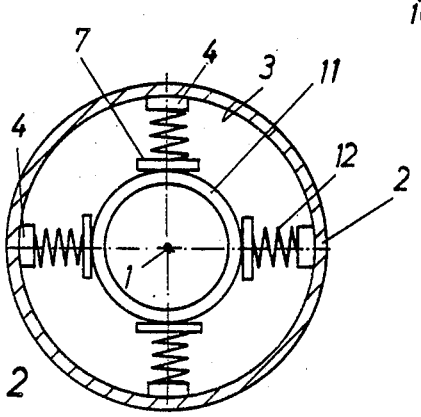
FIG. 2 is a cross-sectional view through the cylinder of FIG. 1.

FIGS. 1 and 2 show a drying cylinder in which one preferred embodiment of the invention is utilized. The cylinder may be used in a paper making machine of the type shown in U.S. Pat. No. 3,217,426 incorporated herein by reference.

In FIG. 1, the axis of the cylinder is indicated by the line 1. Cylinder shell 2 has an inner surface 3 on which ridges 4 lie, and the ridges 4 extend parallel to the cylinder axis 1. The ridges are provided with radially inwardly extending pins 5 which engage corresponding respective holes 6 in the opposite ends of the axial bars 7. The bars 7 are radially spaced from their respective ridges. Each bar 7 has a centrally located borehole 8 that receives the radially outward end of a pin 9. The radially inward end of the pin is threaded to receive the screwed on nut 10. The pin 9 also passes through a supporting element, for example ring 11 which is fastened by the nut 10. The bars 7 are axially positioned so that each ring 11 can be held by a pin 9 at each bar 7. One axial bar 7 generally supports only one ridge 4, as illustrated, but it can also be made so that it supports two or three ridges. Each bar may be rigid in construction. Alternatively, as illustrated, each bar may be resilient and itself be a leaf spring.

Only two ridges 4, spaced 90° apart about the circumference of the cylinder 2, are shown in FIG. 1. The complete cylinder 2 of FIG. 1 therefore has a total of four ridges 4. But, the number of ridges 4 can be selected as desired. Coil compression springs 12 press the axial bars 7 away from the ridges 4, which clamps bars 7 against ring 11. As is indicated by dashed line 11', a plurality of supporting rings 11 can be provided axially spaced along the bars 7. It is also possible, particularly in the case of larger cylinders, to provide a plurality of supporting rings 11 over the length of the cylinder. Each ring 11 is radially elastically deformable and "floats" inside the ring of ridges 4, and via the respective axial bars 7 each ring 11 resiliently presses against the ridges 4 so that the ridges 4 are resiliently urged against the cylinder wall 3. The pressure between the ridges 4 and the cylinder wall 3 produces a powerful frictional clamping effect sufficient to fix the ridges 4 in place within the cylinder 2.

Pressure can be exerted on the ridges 4 at selected points only, for instance by means of coil springs 12 arranged at each end of the axial bars 7, as in FIGS. 1 and 2, or along the entire length of the axial bars 7, for instance by means of an elastic rubber cord disposed between each axial bar and the corresponding ridge 4. If desired, a spring can also be placed between the supporting ring 11 and the axial bar 7.

If the ridges 4 are very long, it is advantageous to divide each of them axially into several segments, each segment being pressed against the wall 3 of the cylinder by at least one supporting ring 10 via respective axial bars 7. This subdivision is advisable when any substantial differential thermal expansion is to be expected between the cylindrical shell 2 and the ridges 4, and it facilitates installing the structure of the present invention in the cylinder 2.

It is also possible to provide the adjoining ends of ridge segments with guide elements to limit relative displacement of the segments. These guide elements can be tongue-and-groove elements, stops, hole-and-pin elements or the like, with or without play.

Figure 3:
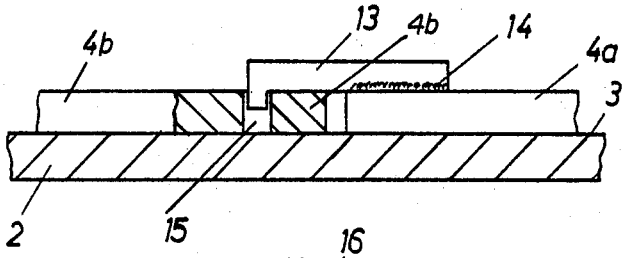
FIG. 3 is a cross-sectional view showing the connection of two segments of a ridge to each other in accordance with another embodiment of the invention.

FIG. 3 shows a second ridge segment 4*a* axially adjoining a ridge segment 4*b*. Ridge segment 4*a* has a bent pin 13 welded to it at 14. The bent portion of pin 13 is accommodated in hole 15 provided for that purpose in ridge segment 4*b*, providing a form-locked attachment of pin 13 to segment 4*b*, preventing any large relative displacements of the ends of the segments 4*a* and 4*b* either axially or about the circumference of cylinder 2.

Figure 4:
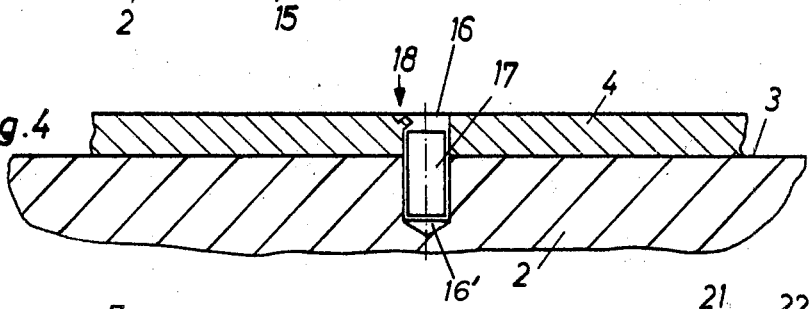
FIG. 4 is an axial cross-sectional view of the cylinder showing one means of fastening a ridge to the cylinder wall in accordance with the invention.

To prevent displacement of the ridges 4 with respect to the cylinder wall 3 altogether, the ridges 4 can be connected by means of fastening pins 17 to the wall 3 of the cylinder. In FIG. 4, a blind hole 16 through the ridge 4 is aligned with a corresponding hole 16' in the cylinder shell 2 and receives a holding pin 17. The holding pin 17 is secured against dropping out by a center-punch tang 18. If this method is used, it is sufficient merely to pin some of the ridges 4 to the cylinder wall 3, since the rest of the ridges 4 will then be held firmly in place by the axial bars 7 and the supporting rings 11 connecting them with the ridges 4 that are fastened to the wall 3.

The supporting ring 11 is preferably elastically deformable radially.

Figure 5:
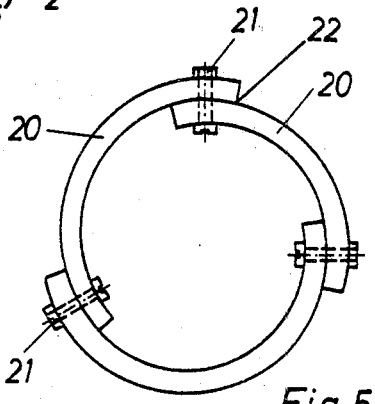
FIG. 5 is an end view of a multi-segment supporting ring according to yet another embodiment of the invention.

As shown in FIG. 5, the supporting ring 11 can be made in several parts, for instance by connecting a plurality of arcuate segments 20 to each other by bolts 21. This is particularly advantageous if the parts must be introduced into the cylinder through a hand hole.

In accordance with another preferred embodiment, instead of relatively rigid axial bars 7, a leaf spring can be placed with its middle portion in direct contact with the supporting ring 11 and with its ends directly or indirectly pressing outward against the ridges.

The structure of the invention is characterized by strength, high stability, and rapid, easy mounting within the cylinder.

Although several preferred embodiments of the present invention have been described in detail herein, many variations and modifications thereof will now be apparent to one skilled in the art. Accordingly, the scope of the invention is to be limited not by the details described herein but only by the terms of the appended claims.

What is claimed is:

1. A cylinder for use in paper making machines, or the like, comprising:

a hollow cylinder having an inner surface; a plurality of ridges extending in the longitudinal direction of said cylinder, applied against said inner surface of said cylinder and annularly arrayed in spaced apart relationship around said inner surface of said cylinder;

a common support in said cylinder for all said ridges; a respective bar extending longitudinally of said cylinder and interposed between said common support and each said ridge; each said bar being in engagement with said common support; a plurality of resilient connections at longitudinally spaced apart locations between each said bar and a said ridge where that said bar is interposed between said common support and that said ridge for resiliently urging said ridges in a direction radially outwardly of said cylinder; said common support restraining motion of each said bar radially inwardly with respect to said cylinder.

2. The cylinder of claim 1, wherein each said resilient connection comprises respective spring means between each said bar and the respective said ridge.

3. The cylinder of either of claims 1 or 2, wherein said common support is resiliently yieldable radially of said cylinder.

4. The cylinder of either of claims 1 or 2, further comprising additional securement means for securing each said ridge against relative displacement with respect to said cylinder inner surface.

5. The cylinder of claim 2, wherein each said bar comprises a leaf spring.

6. The cylinder of claim 2, wherein there are a plurality of said common supports spaced apart longitudinally along said cylinder.

7. The cylinder of either of claims 3 or 6, further comprising a plurality of annular arrays of said ridges, with each said annular array being spaced longitudinally along said cylinder from the longitudinally next adjacent said annular array; a respective said common support for each said array of ridges; a respective said bar for each said ridge; respective resilient connections between each said ridge and the respective said bar therefor.

8. The cylinder of claim 1, further comprising guide elements provided between opposed ends of longitudinally neighboring said ridges for limiting relative longitudinal displacement of longitudinally adjoining said ridges.

9. The cylinder of claim 2, wherein each said bar also extends longitudinally along said cylinder and each said bar is connected with a respective said ridge at at least two spaced apart locations longitudinally along said ridge.

10. The cylinder of claim 9, wherein at each said location a respective spring means is provided for normally urging said bar away from the respective said ridge.

11. The cylinder of claim 9, wherein at each said location, respective pin means are provided for connecting said bar and said ridge; said bar being radially shiftable with respect to its said pin means.

12. The cylinder of claim 11, wherein said pin means each comprise a pin projecting radially inwardly from the respective said ridge and a respective borehole in the respective said bar, said borehole being aligned with the respective said pin, and said pin projecting into said borehole; said bar being radially shiftable with respect to the respective said pins therefor.

13. The cylinder of claim 1, wherein said common support engages each said bar between the outermost spaced apart said locations thereof.

14. The cylinder of claim 13, wherein said common support engages each said bar generally centrally thereof longitudinally therealong, and the outermost said spaced apart locations being generally at the ends of said bar.

15. The cylinder of any of claims 1, 2 5 or 14 wherein said common support comprises a supporting ring supported in contact with each said bar.

16. The cylinder of claim 15, wherein said ring is elastically deformable for applying radially outward force upon said bars.

17. The cylinder of claim 15, wherein said ring is comprised of a plurality of arcuate segments which are joined together to define a complete annular ring.

18. The cylinder of claim 17 wherein each said ring segment has an inner surface, which defines said inner surface of said common support, has an outer surface, and has opposite arcuate ends; said inner surface of one said end of each said segment being secured to said outer surface of one said end of an adjacent said segment.

19. The cylinder of claim 18, wherein said segments are comprised of elastically deformable material.

20. The cylinder of claim 17, wherein said segments are comprised of elastically deformable material.

* * * * *